US008042685B2

(12) United States Patent
Bourgoin et al.

(10) Patent No.: US 8,042,685 B2
(45) Date of Patent: Oct. 25, 2011

(54) HINGED-LID CONTAINER WITH SLIDING DEVICE

(75) Inventors: Philippe Bourgoin, Cheseaux (CH); Kevin Brügger, Kappel (CH)

(73) Assignee: Philip Morris USA Inc., Richmond, VA (US)

( * ) Notice: Subject to any disclaimer, the term of this patent is extended or adjusted under 35 U.S.C. 154(b) by 233 days.

(21) Appl. No.: 12/230,321

(22) Filed: Aug. 27, 2008

(65) Prior Publication Data

US 2009/0065561 A1 Mar. 12, 2009

(30) Foreign Application Priority Data

Aug. 29, 2007 (EP) ..... 07115236

(51) Int. Cl.
*B65D 5/42* (2006.01)

(52) U.S. Cl. ..... 206/267; 206/268

(58) Field of Classification Search ..... 206/267, 206/250, 265, 242, 268; 229/129.1, 130, 229/131
See application file for complete search history.

(56) References Cited

U.S. PATENT DOCUMENTS

| | | | | |
|---|---|---|---|---|
| 149,889 | A | 4/1874 | Smith | |
| 727,600 | A | 5/1903 | Doscher | |
| 1,185,560 | A * | 5/1916 | Walcutt | 229/129.1 |
| 1,459,439 | A | 6/1923 | Burton | |
| 1,562,497 | A | 11/1925 | Roberts | |
| 1,608,229 | A | 11/1926 | Twomley | |
| 2,041,548 | A * | 5/1936 | Holtzman | 206/92 |
| 2,163,828 | A | 6/1939 | Walker | |
| 2,213,525 | A | 9/1940 | LaFlamme | |
| 2,597,810 | A | 5/1952 | Myers | |
| 2,799,441 | A | 7/1957 | Nerney | |
| 2,872,097 | A | 2/1959 | Graybill | |
| 2,929,542 | A | 3/1960 | O'Gorman | |
| 2,990,994 | A | 7/1961 | Hackmyer | |
| 3,311,283 | A | 3/1967 | Katsuji et al. | |
| 3,327,888 | A | 6/1967 | Chalmers et al. | |
| 3,400,874 | A * | 9/1968 | Shimada et al. | 206/250 |
| 3,416,719 | A | 12/1968 | Pilger | |
| 3,858,788 | A | 1/1975 | Phillips, Jr. | |
| 3,899,125 | A * | 8/1975 | Andrews et al. | 220/495.01 |
| 3,933,299 | A | 1/1976 | Shimada et al. | |

(Continued)

FOREIGN PATENT DOCUMENTS

DE 570 351 2/1933

(Continued)

OTHER PUBLICATIONS

International Search Report and Written Opinion mailed Apr. 1, 2009 for PCT/EP2009/000318.

(Continued)

*Primary Examiner* — J. Gregory Pickett
*Assistant Examiner* — King M Chu
(74) *Attorney, Agent, or Firm* — Buchanan Ingersoll & Rooney PC

(57) ABSTRACT

A container comprises a box portion, a lid portion and a separate sliding device. The separate sliding device embraces at least part of the box portion. Moving the separate sliding device longitudinally along the box portion in a first direction pivots the lid portion to open the container and moving the separate sliding device longitudinally along the box portion in a second, opposite direction pivots the lid portion to close the container. The lid portion comprises a lid front wall.

10 Claims, 4 Drawing Sheets

U.S. PATENT DOCUMENTS

| | | | | |
|---|---|---|---|---|
| 3,977,520 | A | 8/1976 | Grimm | |
| 4,015,769 | A * | 4/1977 | Erlich | 206/92 |
| 4,049,117 | A | 9/1977 | Grimm | |
| 4,267,926 | A | 5/1981 | Toimil | |
| 4,646,960 | A * | 3/1987 | Challand | 206/259 |
| 4,714,082 | A | 12/1987 | Banerjee et al. | |
| 4,729,508 | A | 3/1988 | Erdmann et al. | |
| 4,779,723 | A | 10/1988 | Focke et al. | |
| 4,923,059 | A | 5/1990 | Evers et al. | |
| 5,692,525 | A | 12/1997 | Counts et al. | |
| 6,044,973 | A | 4/2000 | Vasudeva | |
| 6,162,516 | A | 12/2000 | Derr | |
| 6,474,468 | B1 | 11/2002 | Griffith | |
| 6,527,166 | B1 | 3/2003 | Focke et al. | |
| 6,591,982 | B2 | 7/2003 | Focke et al. | |
| 7,273,145 | B2 | 9/2007 | Focke et al. | |
| 7,604,117 | B2 | 10/2009 | Bourgoin et al. | |
| 2002/0000389 | A1 | 1/2002 | Garcia | |
| 2004/0026271 | A1 | 2/2004 | Conti et al. | |
| 2004/0026272 | A1 | 2/2004 | Conti et al. | |
| 2005/0029131 | A1 | 2/2005 | Draghetti et al. | |
| 2005/0103654 | A1 | 5/2005 | Hennessy | |
| 2006/0278542 | A1 * | 12/2006 | Pham et al. | 206/268 |
| 2008/0121538 | A1 | 5/2008 | Buse | |
| 2008/0128301 | A1 | 6/2008 | Bourgoin et al. | |
| 2008/0142578 | A1 | 6/2008 | Vickerstaff | |
| 2009/0008277 | A1 | 1/2009 | Agirbas | |
| 2009/0184158 | A1 | 7/2009 | Lutzig et al. | |
| 2010/0032324 | A1 | 2/2010 | Lutzig et al. | |
| 2010/0065449 | A1 | 3/2010 | Morgan et al. | |
| 2010/0155273 | A1 | 6/2010 | Chatelain | |
| 2010/0176011 | A1 | 7/2010 | Chatelain | |

FOREIGN PATENT DOCUMENTS

| | | | |
|---|---|---|---|
| DE | 1054373 | B | 4/1959 |
| DE | 7525528 | U | 12/1975 |
| DE | 7826336 | U1 | 12/1978 |
| DE | 90 11 464 | | 1/1991 |
| DE | 202005011562 | U1 | 9/2005 |
| EP | 1927549 | A1 | 11/2006 |
| EP | 1847478 | A1 | 10/2007 |
| FR | 1037831 | A | 9/1953 |
| FR | 2495114 | A | 6/1982 |
| GB | 395 501 | | 7/1933 |
| GB | 468409 | | 7/1937 |
| GB | 532 784 | | 1/1941 |
| GB | 1042445 | | 9/1966 |
| GB | 1075618 | A | 7/1967 |
| GB | 2 309 021 | A | 7/1997 |
| GB | 2 396 854 | A | 7/2004 |
| IT | EP0769457 | A1 * | 4/1997 |
| JP | 2000-85749 | | 3/2000 |
| WO | WO 03/024839 | A | 3/2003 |
| WO | WO 03/091130 | | 11/2003 |
| WO | WO 2005/016036 | A1 | 2/2005 |
| WO | WO 2007/028481 | A1 | 3/2007 |
| WO | WO 2007/060395 | A1 | 5/2007 |
| WO | WO 2008/065038 | | 6/2008 |

OTHER PUBLICATIONS

International Search Report dated Jun. 4, 2008 for European Patent Application No. 08253880.2-1261.

International Preliminary Report on Patentability issued Mar. 2, 2010 for PCT/IB2008/003014.

International Search Report and Written Opinion mailed May 11, 2009 for PCT/IB2008/003014.

Search Report from European Patent Application No. EP07115236.

International Search Report and Written Opinion mailed Apr. 8, 2010 for PCT/EP2009/009215.

European Search Report dated May 2, 2007, issued in European Patent European Application No. EP 06 25 6126.

International Search Report for European Application No. 06125140.1-2308 dated May 2, 2007.

International Search Report and Written Opinion mailed Apr. 21,2010 for PCT/EP2009/008831.

International Search Report dated Feb. 3, 2010 for European Patent Application No. 09252010.5-2308.

U.S. Appl. No. 12/858,874 to Chatelain et al., filed Aug. 18, 2010.

* cited by examiner

HINGED-LID CONTAINER WITH SLIDING DEVICE

CROSS REFERENCE TO RELATED APPLICATION

This application claims priority under 35 U.S.C. §119 to European Application No. 07115236.7, filed Aug. 29, 2007, entitled IMPROVED HINGED-LID CONTAINER WITH SLIDING DEVICE, the entire content of which is hereby incorporated by reference.

FIELD OF THE INVENTION

The invention relates to a novel hinge-lid container comprising a sliding device and in particular to a novel hinge-lid container for consumer goods, for example elongate smoking articles such as cigarettes.

BACKGROUND

Smoking articles such as cigarettes and a variety of other consumer goods are commonly sold in hinge-lid packs. These hinge-lid packs comprise a box portion and a lid portion, which is hinged to the back wall of the box portion. Such packs are formed from laminar cardboard blanks that include various panels and flaps, which when folded about appropriate score lines around a pre-wrapped bundle of cigarettes form the box portion and the lid portion of the hinge-lid pack.

Hinge-lid packs comprising a sliding device embracing the box portion are known. In such known packs the lid portion is opened and closed by moving the sliding device along the pack. Such packs are disclosed, for example, in U.S. Pat. Nos. 2,990,994, 3,400,874 and 3,858,788. In the pack disclosed in U.S. Pat. No. 3,400,874 the sliding device is a separate element which can be moved up to the top edge of the lid portion to bring the pack into a closed position. However, in this closed position the pack has an undesirable gap between the sliding device and the top edge of the lid. In the pack disclosed in U.S. Pat. No. 3,858,788 the sliding device is not a separate element. Instead a rigid connection exists between the sliding device and the lid portion. Due to the rigidity of that connection, it is impossible to move the sliding device all the way up the pack in the closed position. As a result the sliding device is stuck between the ends of the pack. According to U.S. Pat. No. 2,990,994 the sliding device is connected to the lid portion by a flexible connection and it is therefore possible to move the sliding device all the way up in the closed position. However, due to the flexible connection between the sliding device and the lid portion the opening mechanism is complicated. Furthermore, the blank to form this pack is not suitable for mass production.

There is a need for hinge-lid containers with a sliding device with improved handling. Furthermore, there is a need for such a container with an improved closure.

SUMMARY

According to the present invention there is provided a container comprising a box portion, a lid portion and a separate sliding device, wherein the separate sliding device embraces at least part of the box portion. Moving the separate sliding device longitudinally along the container in a first direction pivots the lid portion to open the container. Moving the separate sliding device longitudinally along the container in a second, opposite direction pivots the lid portion to close the container. The lid portion comprises a lid front wall.

The term "separate sliding device" is used throughout the specification to denote that the sliding device is not permanently affixed to any part of the box portion or the lid portion of the container. Still, the sliding device interacts with elements of the lid portion in order to affect the opening and the closing of the container.

As the sliding device is a separate element, the sliding device may be moved all the way up to the upper end of the lid portion in the closed position of the container. Due to the presence of the front wall, no gap shows between the lid portion and the sliding device in the closed position of the container. The improved closure of the container due to the lid front wall increases the freshness of the content of the container. Additionally, the number of small particles exiting the container in its closed position is advantageously decreased.

When the container is placed in an upright position, that is standing on the box bottom wall, the first direction of the longitudinal movement of the sliding device is downwards and the second direction of the longitudinal movement of the sliding device is upwards. The container is in its closed position when the sliding device has reached the end of the upward movement. The container is in its open position when the sliding device has reached the end of the downward movement.

Preferably, the lid front wall has a length of about 2 mm to about 10 mm, more preferably about 4 mm.

Preferably, the lid portion comprises a lid underside wall extending from a first end of the lid front wall and a lid top wall extending from the second, opposite end of the lid front wall. The length of the lid underside wall is greater than the length of the lid top wall. The lid underside wall consists of a lid inner top wall and an angled wall. The lid inner top wall and the angled wall are connected by a material bridge.

This longer underside wall adds structural strength to the lid front wall as it supports the lower end of the lid front wall against the underside of the lid. Additionally, the angled wall supports the lid side walls.

The term "extends from" is used throughout the specification to describe the relation between two walls or flaps of the container or the respective panels of the blank. A first wall or panel extends from a second wall or panel, if there is a material bridge connecting the edge of the wall or panel to the edge of the adjacent wall or panel. This material bridge may be a scoring line, a folding line, a creasing line, a perforated line, a hinge line, any other weakening line or any other material bridge.

The length of a wall or panel is defined as the distance between two edges of a panel, measured perpendicular to the direction of the hinge line in the flat blank.

Preferably, the angled wall supports the lid front wall such that the lid front wall is at an angle of about 90 degrees to the lid top wall. This angle of about 90 degrees between the lid front wall and the lid top wall ensures that the lid front wall and the front wall of the sliding device are parallel and adjacent to each other when the container is in the closed position. Furthermore, this prevents the upper edge of the sliding device from interacting with the lower edge of the lid front wall and becoming jammed. Additionally, it minimizes any visible gap between the lid portion and the sliding device.

The lid portion comprises a lid flap, extending from the lid's top back edge in the first direction beyond the hinge of the lid portion and the lid flap further comprises a lid end flap, extending from the lower end of the lid flap which is bent upward.

The sliding device comprises a slide top edge, a slide bottom edge, a slide top flap extending from the slide top edge and a slide bottom flap extending from the slide bottom edge, wherein both slide flaps are bent inwardly. These flaps interact with the lid end flap of the lid portion.

When the sliding device is moved a given distance in the first direction the slide top flap contacts the lid end flap. When moving the sliding device further in the first direction the lid end flap is pulled along the sliding device. This opens the container by pivoting the lid portion backwards.

Preferably the lid portion comprises a lid top wall and a lid side wall, wherein the lid top wall extends sideways over the lid side wall to limit movement of the sliding device in the second direction. This also improves the look of the container when closed as the sides are entirely covered by the lid top wall when looked on from above.

Preferably the sliding device comprises a slide front wall and a slide inner front flap extending from the slide front wall, folded by 180 degrees into the sliding device. This advantageously adds structural strength to the sliding device. This makes the sliding device more resistant to wear and gives the container an improved look, particularly when closed.

Preferably the sliding device covers substantially half of the box portion or less. The sliding device may contain cut outs or other transparent areas.

Preferably the box portion and the lid portion are made from one blank and the sliding device is made from a separate blank, wherein the two blanks are not permanently affixed to each other.

Alternatively, the box portion and the lid portion are made from separate blanks wherein the two blanks are adhered to each other in the region of the lid back wall. With this, the production of the container is greatly simplified. Due to the separation of the box portion and the lid portion, the production of the box portion is similar to the production of the box portion of a common hinge lid container. As such, standard machinery may be used for the high speed production of the box portion of the container.

This advantageously speeds up the entire production process. Additionally, the two blanks of this alternative embodiment of the container need to be printed or coated only on one side as opposed to printing or coating on both sides for a container with a box portion and a lid portion formed from a single blank. This may advantageously reduce the production cost. Besides, the separation of the blank of the box portion and the lid portion may be used also for other packs, in particular for a slide and shell container wherein the lid portion and the sliding device are not separate elements.

According to a further embodiment the container is a carton, containing a number of smaller containers, for example ten cigarette packs. Alternatively, the container may contain any other consumer goods.

According to a further embodiment there is provided a container comprising a box portion, a lid portion and a sliding device, wherein said box portion comprises a box front wall and a box back wall, wherein the lid portion is hinged to the box back wall and wherein the sliding device embraces at least part of the box portion. According to this further embodiment the box portion comprise box side walls and at least one of the box side walls comprises at least one friction element protruding from the box side walls towards the box front wall, engaging with the sliding device.

Preferably, the sliding device comprises a slide inner front panel, wherein the slide inner front panel comprises engaging flaps, such that the engaging flaps engage with the friction elements of the box side walls. Preferably, the engaging flaps are not attached to the inside of the front wall of the sliding device. Preferably, the engaging flaps are located on the slide inner front panel such that the friction elements are locked between the top position of the sliding device and the upper part of the engaging flaps in the closed position of the container. To open the container, the increased friction between the friction element and the engaging flap has to be overcome. This further improves the closure of the container. Likewise, the dimensions of the engaging flaps and the friction elements may be chosen such that also in the open position of the container, the friction elements lock behind the other side of the engaging flaps in order to keep the sliding device in the open position of the container. Alternatively, other suitable retention means may be employed to keep the container either in the closed or in the open position. Examples are magnets, Velcro® strips, low tack adhesives, embossed or debossed areas on the sliding device or on the box portion or any mixture thereof.

All customary materials may be used as foldable materials for the blanks, particularly the papers and cardboards usually used for cigarette packs, with or without coating, but also plastic materials. Different materials may be used for the two blanks, for example the sliding device blank may be made of plastic and the box blank may be made from cardboard. Alternatively, different types of cardboard may be used, for example cardboards with different thicknesses. One or more of the blanks may be embossed or debossed, printed in special colours, covered with special lacquer, metallization, holograms, luminescence or other materials changing the feel, odour or visual appearance of the blank. Additionally, one or more of the blanks, for example the sliding device blank, may be made of transparent material.

DETAILED DESCRIPTION

Figure 1:
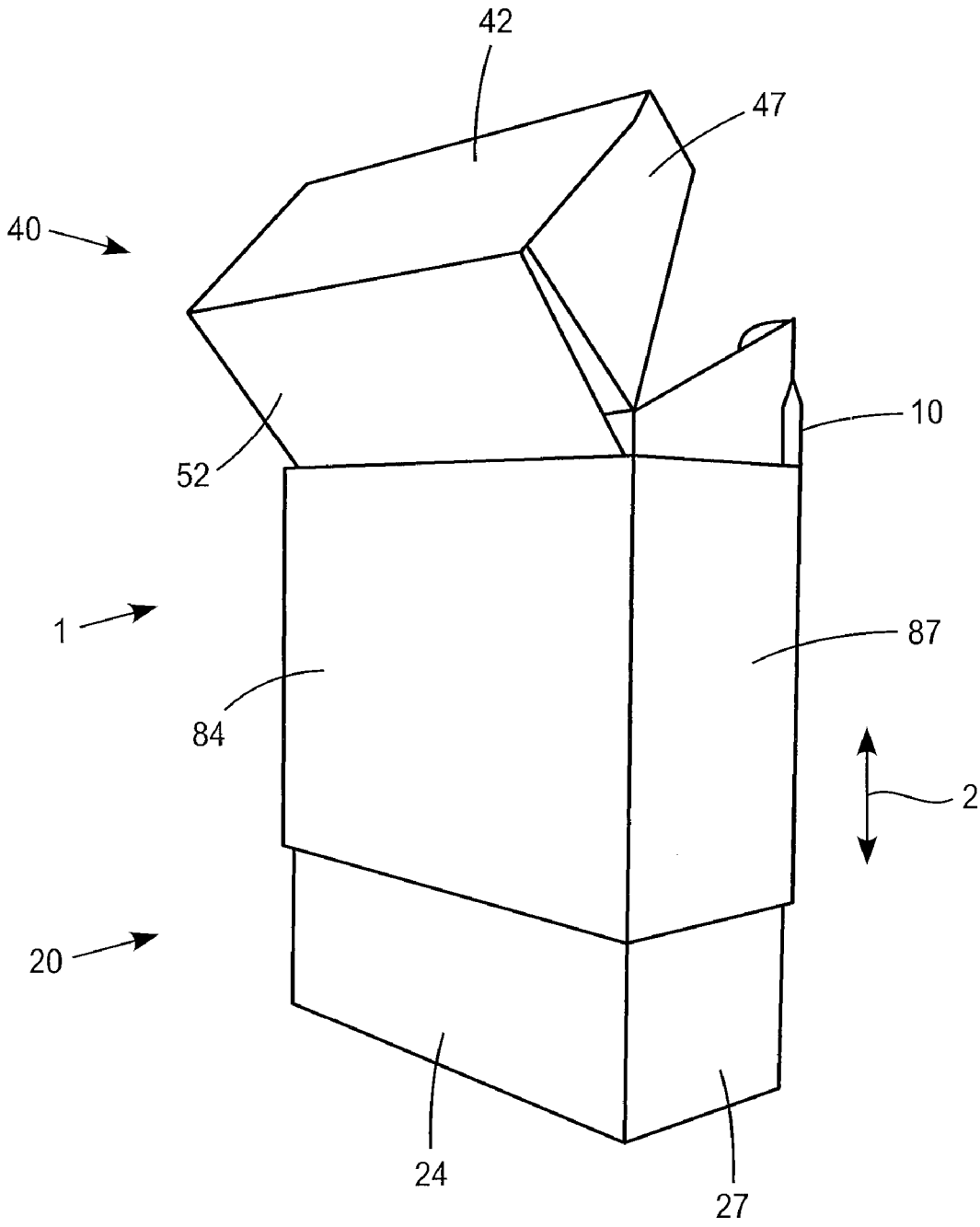
FIG. 1 is a perspective view of the container according to a preferred embodiment.

In FIG. 1 the assembled container 1 is shown. The sliding device 80 is slid over the container 1 and is longitudinally movable along the arrow 2 in a first direction down towards the bottom of the container 1 and in a second direction up towards the top of the container 1. Friction flaps 10 extend from the box side walls 26, 27 towards the front of the container 1.

Figure 2:
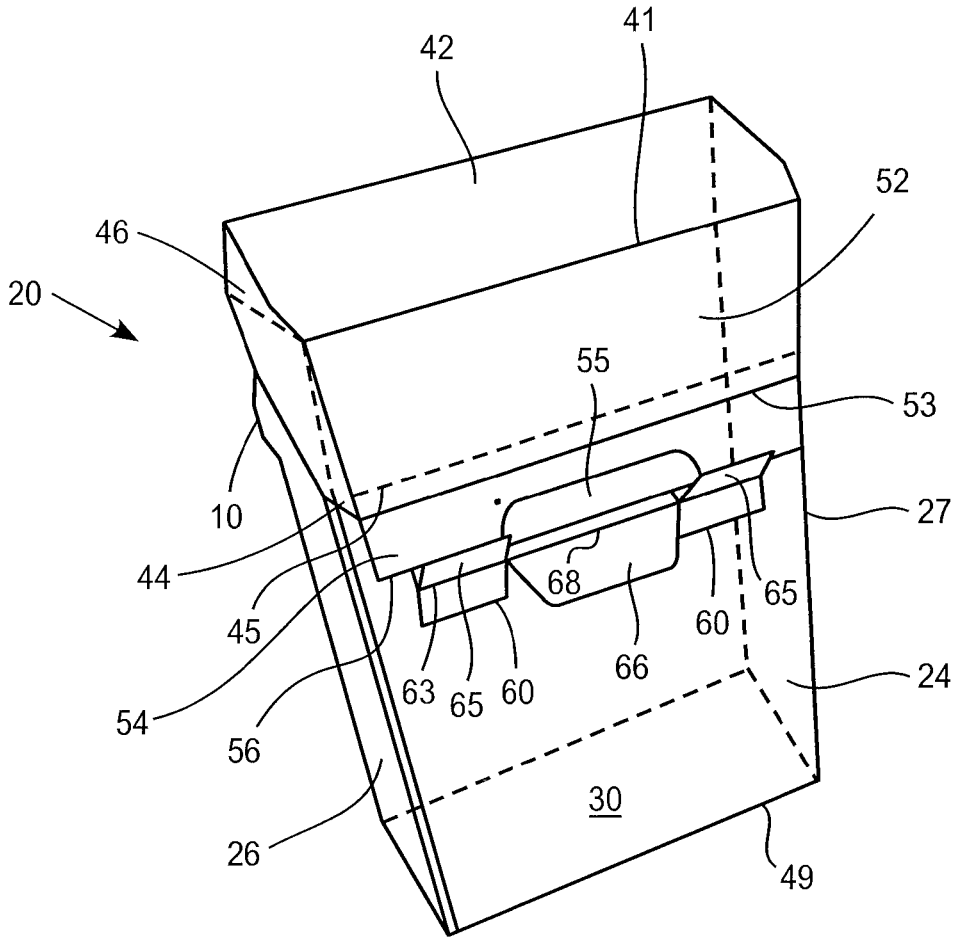
FIG. 2 is a perspective view of the box portion and lid portion of the container according to a preferred embodiment, without the sliding device.

As shown in FIG. 2, the container 1 comprises a box portion 20 with a box bottom wall 30, two box side walls 26, 27, a box front wall 22 and a box back wall 24.

In the box back wall 24 is a wavelike incision 60 and a common fold line 63, 68 which crosses the wavelike incision 60 such that three stopper flaps 65, 66 are formed when folded along said common fold line 63, 68. Due to the wavelike form of the incision 60 the first stopper flaps 65 are folded along the fold line 63 towards the top of the container 1, whereas the second stopper flap 66 is folded along the fold line 68 towards the bottom of the container 1.

A lid portion 40 extends from the box back wall 24 along a hinge fold line 45. The lid portion 40 comprises a lid back wall 44, a lid top wall 42 and two lid side walls 46, 47. Additionally the lid portion 40 comprises a lid flap 52, 54 consisting of a lid flap 52 and a lower lid flap 54. The lid flap 52 extends from the lid top wall 42 along the lid upper edge 41 to the back of the lid portion 40. The lower lid flap 54 is separated by a fold line 53 from the lid flap 52. A lid end flap 55 extends from that lower lid flap 54 and is bent upward along the fold line 56.

The lid top wall 42 is broader than the box bottom wall 30, extending over the lid side walls 46, 47 and the box side walls 26, 27 by about the thickness of the walls of the sliding device 80. Additionally the box side walls 26, 27 have an incision near the box front wall 22 so that friction flaps 10 are formed on each side of the box front wall 22.

Figure 3:
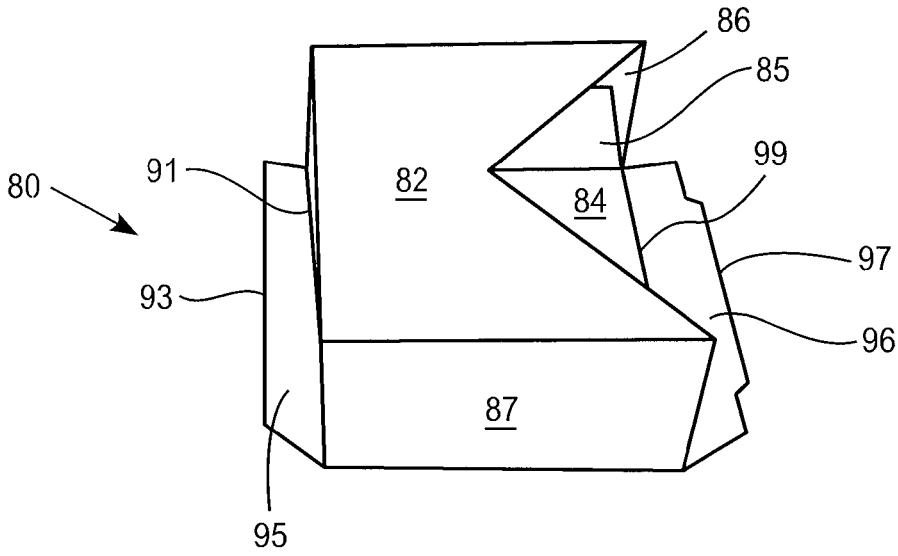
FIG. 3 is a perspective view of the sliding device according to a preferred embodiment.

As shown in FIG. 3, the sliding device 80 comprises a slide front wall 82, two slide side walls 86, 87 and a slide back wall 84. A second slide side wall 85 is adhered to one of the slide side walls 86 to form a sleeve. Extending from the slide back wall 84 is a slide top flap 95 folded around the slide top edge 91 inwardly. Also extending from the slide back wall 84 is a slide bottom flap 96 that is folded inwardly around the slide bottom edge 99.

Figure 4:
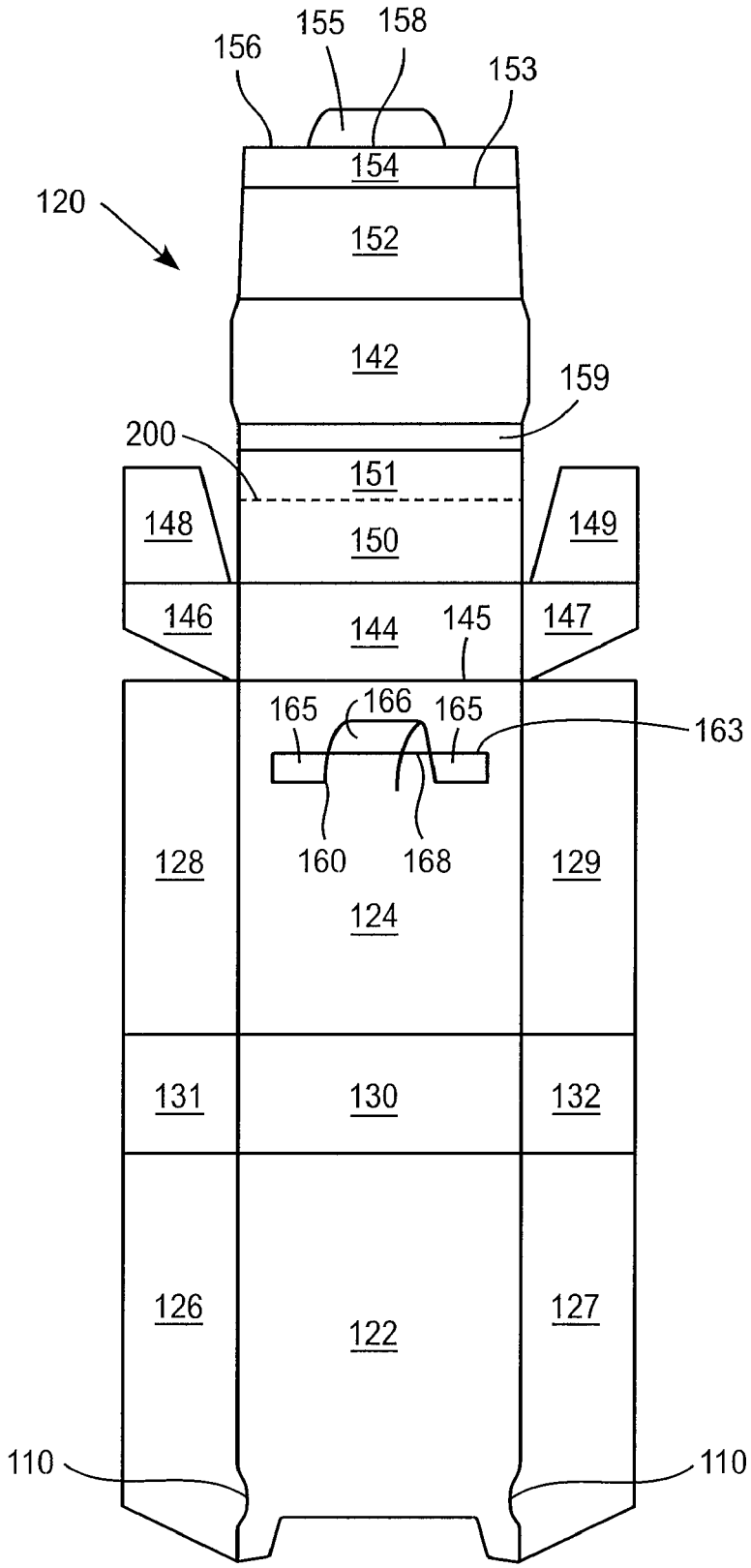
FIG. 4 is a view of a laminar cardboard blank for the box part of the container according to a preferred embodiment.
Figure 5:
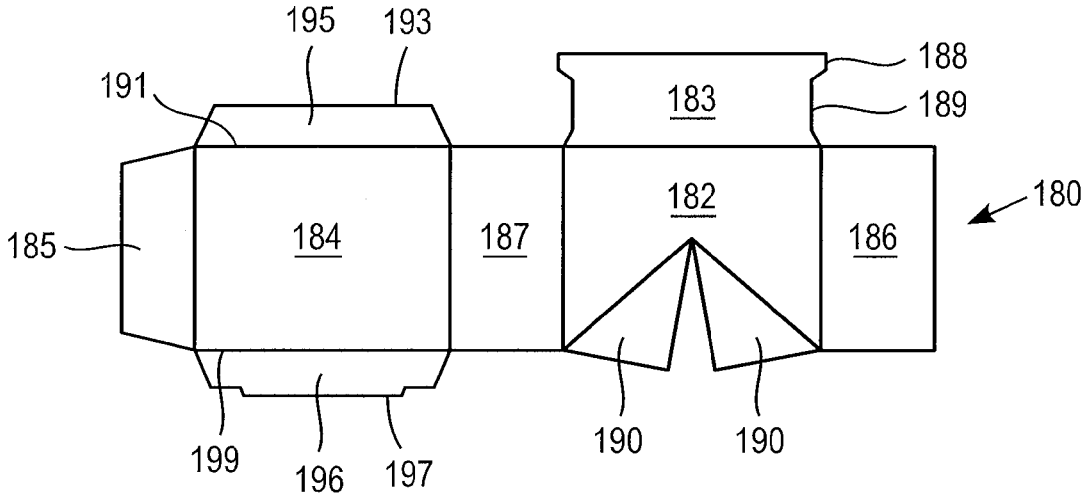
FIG. 5 is a view of a laminar cardboard blank for the sliding device of the container according to a preferred embodiment.

FIG. 4 shows the blank 120 from which the box portion 20 and the lid portion 40 are made. FIG. 5 shows the blank 180 from which the sliding device 80 is made. Both blanks are preferably made from laminar cardboard. In these FIGS. 4 and 5 the panels and fold lines of the blanks corresponding to walls, flaps and fold lines of the box portion 20, the lid portion 40 or the sliding device 80 are referred to by the corresponding reference numerals plus 100. For example the box front panel 122 corresponds to the box front wall 22 when the container 1 is erected.

Extending from the box front panel 122 are the box outer side panels 126, 127 and the box bottom panel 130. From the box bottom panel 130 two bottom dust panels 131, 132 extend, which are adhered to the respective box inner side panels 128, 129. Also extending from the box bottom panel is the box back panel 124. Extending from the box back panel are the two box inner side panels 128, 129. The box outer side panels 126, 127 are adhered onto the two box inner side panels 128, 129 respectively. The box back panel is limited on the upper side by a hinge fold line 145 which forms the hinge 45 of the lid portion 40.

Extending along the hinge fold line 145 from the box back panel 124 is the lid back panel 144. Extending from the sides of the lid back panel 144 are two lid side panels 146, 147. Extending from these lid side panels 146, 147 is one lid dust flap 148, 149 each. When erecting the container 1 these lid dust flaps 148, 149 are adhered to the lid inner top panel 150 which is extending form the lid back panel 144. Extending from the lid inner top panel 150 is the angled section panel 151. A weakening line 200 separates the lid inner top panel 150 and the angled section panel 151. Other than the lid inner top panel 150, the angled section panel 151 is not adhered to the dust flaps 148, 149, as may be seen in FIG. 6. From the angled section panel 151 extends the lid front panel 159. From the lid front panel 159 extends the lid top panel 142, which is folded 90 degrees backward and adhered onto the lid inner top panel 150 and the upper part of the dust flaps 148, 149. The lid top panel is extending sideways over the lid inner top panel 150, particularly extending about the thickness of the laminar cardboard or other material the sliding device 80 is made of. Extending from the lid top panel 142 is a lid flap panel 152 along fold line 153. From the lid flap panel 152 extends a lower lid flap panel 154. Extending from the lower lid flap panel 152 is a lid end flap panel 155 along a fold line 156.

Figure 6:
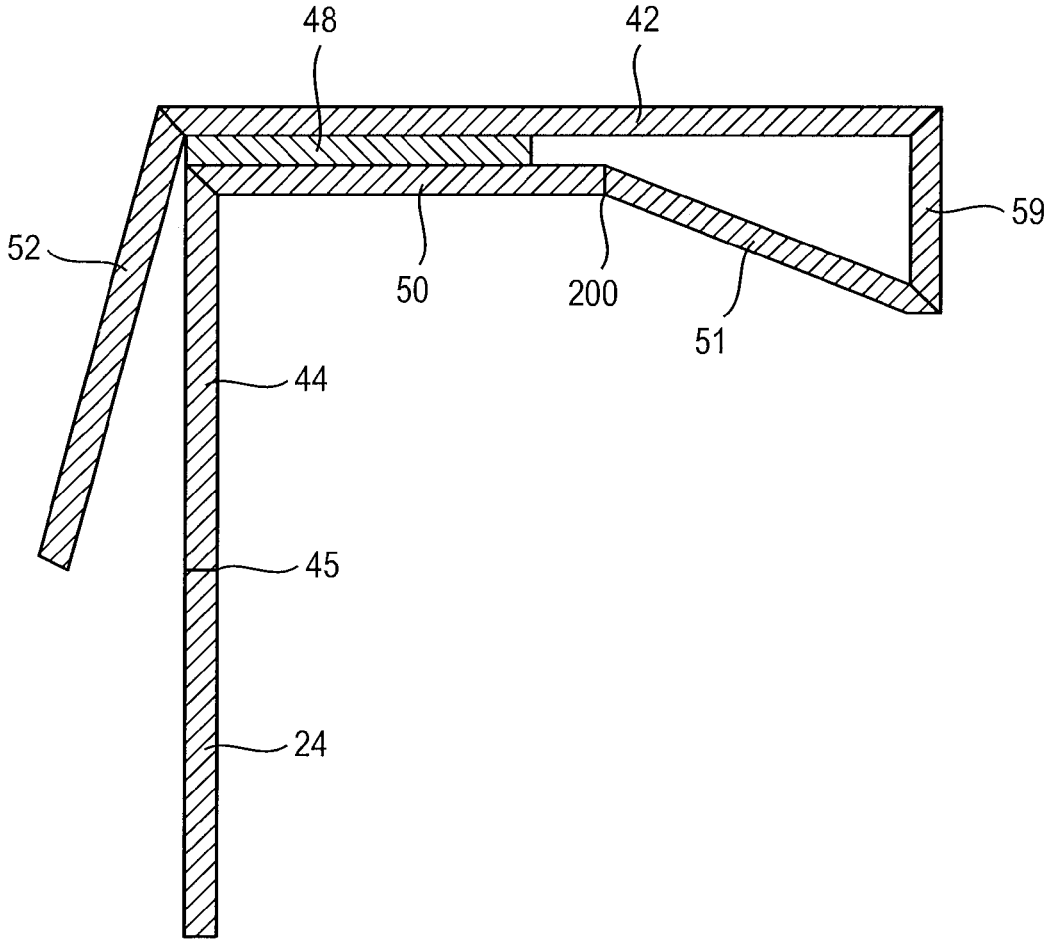
FIG. 6 is a cross section of parts of the lid portion of the container according to the preferred embodiment.

In FIG. 6 a cross section illustrates the layout of the lid portion 40. The lid back wall 44 extends via the hinge 45 from the box back wall 24. The lid inner top wall 50 extends from the lid back wall 44 at an angle of about 90 degrees and is attached to the dust flap 48 from below. Across a perforated line 200 extends the angled section 51 of the lid underside 50, 51 from the lid inner top wall 50. The lid front wall 59 depends from the angled section 51. The lid top wall 42 extends at an angle of about 90 degrees from the lid front wall 59 and is likewise attached to the dust flap 48 from above. The lid flap 52 finally extends from lid top wall 42. The position where the lid inner top wall 50 and the lid top wall 42 are attached to the dust flap 48 and the length of the angled section 51 determines the angle between the lid front wall 59 and the lid top wall 42.

In an alternative embodiment of the container (not shown), one blank is used for each of the box portion 20 and the lid portion 40. The difference between the two blanks of the alternative embodiment and the blank 120 of FIG. 4 is that the lid inner top panel 150 of blank 120 is present in the first blank that forms the box portion 20 and in the second blank that forms the lid portion 40. After forming the box portion 20 of the container 1, preferably around a bundle of cigarettes, the second blank of the lid portion 40 may be attached to the first blank of the box portion by attaching the two lid inner top panels 150 to each other. For example the two lid inner top panels 150 may be glued to each other using glue spots, glue lines or any other suitable glue pattern, or with a double sided sticker. Preferably the two lid inner top panels 150 have substantially the same size. Thereafter the container 1 of this alternative embodiment is assembled like a container 1 with a box 20 made from a single blank 120. Preferably, the manufacturing of the box portion is performed automatically in a first step. In a second step, after the two lid inner top panels 150 are attached to each other, the final assembly of the container 1 may be either performed automatically or manually.

The sliding device blank 180 comprises a slide front panel 182. Extending from the slide front panel 182 are two slide side panels 186, 187, a slide inner front panel 183 and two triangular slide inner front panels 190. When the sliding device 80 is assembled from the sliding device blank 180 the slide inner front panel 183 and the two triangular slide inner front panels 190 are bent inward into the sliding device sleeve. By this nearly the entire inner area of the slide front panel 182 is covered, which strengthens the slide front wall 82. The slide inner front panel 183 has on each side a cut out 189 which reduces the width of the slide inner front panel. Additionally, an engaging flap 188 is formed at the free ends of the slide inner front panel 183.

Extending from one of the slide side panels 187 is the slide back panel 184. Extending from the slide back panel 184 is a slide inner side panel 185, which is adhered to the back of the other slide side panel 186, forming the sleeve of the assembled sliding device 80. Also extending from the slide back panel 182 along the fold line 191 is a slide top flap panel 195, forming the slide upper edge 91 in the assembled sliding device 80. Also extending from the slide back panel 182 along the fold line 191 is a slide bottom flap panel 196, forming the slide bottom edge 99 in the assembled sliding device 80.

When the container 1 is assembled and the slide 80 embraces the box portion 20, the longitudinal movement of the sliding device 80 along the box portion 20 in the first direction towards the bottom of the box portion 20 causes the slide upper flap 95 to contact the lid end flap 55. At this point the upper edge 91 of the sliding device 80 has passed the hinge 45.

When the sliding device 80 is moved further along the first direction towards the bottom of the box portion 20, the slide top flap 95 pulls the lower lid flap 54 and lid flap 52 along until the movement is stopped by the first stopper flaps 65. By pulling the lower lid flap 54 and lid flap 52 into the first direction the lid portion 40 pivots about the hinge line 45 and the lid flap 52 pivots along the fold line 53.

The opening movement of the lid portion 40 is terminated by the interlocking of the outer edge 56 of the lower lid flap 54 and the slide top flap 95 with the first stopper flaps 65. Thus the opening angle of the lid portion 40 is defined by the distance the lower lid flap 54 travels into the first direction.

When moving the sliding device in the opposite, second direction towards the lid portion 40 of the container 1, the upper edge 91 of the sliding device 80 pushes the lid flap 52 in a position parallel to the back wall 24 of the container 1, thereby closing the container 1.

The movement of the sliding device 80 in the second direction is limited by two mechanisms. Firstly the slide bottom flap 96 contacts the second stopper flap 66. Secondly the movement of the sliding device 80 is limited by the lid top panel 42, which extends into the path of the sliding device 80 in the second direction.

The ease of movement of the sliding device 80 in either direction along the box portion 20 is controlled by the size of the friction flaps 10 on the side walls 26, 27 of the box, engaging in frictional engagement with the inner surfaces of the slide side walls 86, 87 of the sliding device 80 and the engaging flaps 188 of the slide inner front panel 183. When in the open position of the container, the friction flaps 10 are located below the engaging flaps 188 of the sliding device 80 in the area of the cut outs 189. When in the closed position of the container, the friction flaps 10 are located above the engaging flaps 188 of the sliding device 80 in the area of cut outs 189. In each of these positions, the engaging flaps 188 engage with the friction flaps 10 to keep the slider in the respective position. An additional force has to be exerted on the sliding device 80 in order to overcome the engagement of the engaging flaps 188 and the friction flaps 10 and to initially move the sliding device out of one of the extreme positions.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

The invention claimed is:

1. A container comprising a box portion, a lid portion and a separate sliding device coupled to the lid portion, wherein said separate sliding device embraces at least part of said box portion and wherein moving said separate sliding device longitudinally along the container in a first direction pivots said lid portion to open said container and moving said separate sliding device longitudinally along said container in a second, opposite direction pivots said lid portion to close said container, wherein said lid portion comprises a lid front wall, wherein said lid portion further comprises lid side walls, a lid underside wall extending from a first end of the lid front wall, a lid top wall extending from a second, opposite end of the lid front wall, wherein said lid underside wall consists of an inner lid top wall lying parallel to the lid top wall and an angled wall and wherein the length of said lid underside wall is greater than the length of said lid top wall, and wherein said sliding device includes a front wall.

2. The container according to claim 1, wherein said lid front wall is supported by said angled wall such that the lid front wall is at an angle of about 90 degrees to the lid top wall.

3. The container according to claim 1, wherein said lid portion comprises a lid flap extending from a lid top wall back edge downwardly beyond a hinge of said lid portion, said lid flap further comprising a lid end flap, extending from the lower end of said lid flap and being folded upward such that a slide top flap of said sliding device interlocks with said lid end flap when said sliding device is moved in the first direction so that said lid portion is opened.

4. The container according to claim 3, wherein said sliding device comprises a slide top edge, a slide bottom edge, a slide top flap extending from said slide top edge and a slide bottom flap extending from the slide bottom edge and wherein both slide flaps are bent inwardly into the sliding device.

5. The container according to claim 1, wherein said box portion comprise box side walls, wherein at least one friction element protrudes from at least one of said box side walls towards said box front wall, engaging with said sliding device and wherein said sliding device comprises a slide inner front, wherein said slide inner front panel comprises at least one engaging flap.

6. The container according to claim 1, wherein said lid portion comprises a top panel and a side panel, wherein said top panel extends sideways over said side panel to limit movement of the sliding device in said second direction.

7. A container comprising a box portion, a lid portion and a sliding device coupled to the lid portion, wherein said sliding device embraces at least part of said box portion, wherein said box portion comprises a box front wall and a box back wall, wherein said lid portion is hinged to said box back wall, wherein said box portion comprise box side walls, at least one of said box side walls comprising at least one friction element protruding from said box side wall towards said box front wall, engaging with said sliding device, wherein said lid portion further comprises lid side walls, a lid underside wall extending from a first end of the lid front wall, a lid top wall extending from a second, opposite end of the lid front wall, wherein said lid underside wall consists of an inner lid top wall lying parallel to the lid top wall and an angled wall and wherein the length of said lid underside wall is greater than the length of said lid top wall, and wherein said sliding device includes a front wall.

8. The container according to claim 7, wherein said sliding device comprises a slide inner front panel, wherein said slide inner front panel comprises engaging flaps.

9. The container according to claim 1, wherein said box portion and said lid portion are made from separate blanks which are adhered to each other.

10. A container comprising:

a box portion;

a lid portion, said lid portion comprising a lid front wall, lid side walls, a lid underside wall extending from a first end of the lid front wall, a lid top wall extending from a second, opposite end of the lid front wall, and a lid flap extending from a lid top wall back edge downwardly beyond a hinge of said lid portion and comprising a lid end flap extending from the lower end of said lid flap, said lid underside wall consisting of an inner lid top wall lying parallel to the lid top wall and an angled wall which supports said lid front wall such that the lid front wall is at an angle of about 90 degrees to the lid top wall; and a separate sliding device embracing at least part of said box portion, said sliding device comprising a front wall, a slide top edge, a slide bottom edge, a slide top flap extending from said slide top edge and a slide bottom flap extending from the slide bottom edge and wherein both slide flaps are bent inwardly into the sliding device, wherein moving said separate sliding device longitudinally along the container in a first direction pivots said lid portion to open said container and moving said separate sliding device longitudinally along said container in a second, opposite direction pivots said lid portion to close said container, wherein said lid end flap is folded upward such that said slide top flap of said sliding device interlocks with said lid end flap when said sliding device is moved in the first direction so that said lid portion is opened and wherein the length of said lid underside wall is greater than the length of said lid top wall.

* * * * *